US006681608B1

(12) United States Patent
Hope, III

(10) Patent No.: US 6,681,608 B1
(45) Date of Patent: Jan. 27, 2004

(54) KEY RING OPENER ASSEMBLY

(76) Inventor: Paul M. Hope, III, P.O. Box 1973, Idyllwild, CA (US) 92549

( * ) Notice: Subject to any disclaimer, the term of this patent is extended or adjusted under 35 U.S.C. 154(b) by 0 days.

(21) Appl. No.: 10/233,386

(22) Filed: Sep. 3, 2002

(51) Int. Cl.[7] ..... A44B 15/00
(52) U.S. Cl. ..... 70/456 R; 70/459
(58) Field of Search ..... 70/456 R, 457, 70/458, 459; D3/207, 208, 210

(56) References Cited

U.S. PATENT DOCUMENTS 765,754 A * 7/1904 Siersdorfer
1,710,510 A * 4/1929 Ottinger
2,451,091 A * 10/1948 Johnson
4,325,273 A * 4/1982 Gibbons ..... 81/3 R
4,543,860 A * 10/1985 Van Meter ..... 81/488
4,706,477 A * 11/1987 Rousseau ..... 70/456 R
4,719,778 A * 1/1988 Murphy et al. ..... 70/456 R
4,790,161 A * 12/1988 Dick ..... 70/456 R
5,373,717 A * 12/1994 Gore et al. ..... 70/456 R
D374,344 S * 10/1996 Sunderland et al. ..... D3/211
5,722,277 A * 3/1998 Williams ..... 70/456 R
D404,621 S * 1/1999 Liese ..... D8/16
6,092,405 A * 7/2000 Berwick ..... 70/408

* cited by examiner

*Primary Examiner*—Lloyd A. Gall

(57) ABSTRACT

A key ring opener assembly for prying open the key ring so that keys and other objects can be placed upon the key ring. The key ring opener assembly includes a key ring having end portions overlapping ring segments thereof; and also includes a key ring opener being connectable to the key ring and being generally a thin rigid piece with flat first and second sides for spreading apart a selected end portion and a selected ring segment of the key ring to allow keys and other objects to be placed on the key ring; and further includes a connector for connecting the key ring opener to the key ring.

3 Claims, 2 Drawing Sheets

10
11
12
13
14
15
16
17
18
19
20
21
22
23
24
25
26
27
28
29
30
31
32
33
34

KEY RING OPENER ASSEMBLY

BACKGROUND OF THE INVENTION

1. Field of the Invention

The present invention relates to key rings and openers thereof and more particularly pertains to a new key ring opener assembly for prying open the key ring so that keys and other objects can be placed upon the key ring.

2. Description of the Prior Art

The use of key rings and openers thereof is known in the prior art. More specifically, key rings and openers thereof heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,458,097; 5,239,951; 5,746,167; 6,032,630; 5,931,125; and U.S. Pat. No. Des. 440,837.

While these devices fulfill their respective particular objectives and requirements, the aforementioned patents do not disclose a new key ring opener assembly. The prior art includes inventions key ring openers of various structures used to spread apart the segments of the key ring.

SUMMARY OF THE INVENTION

The general purpose of the present invention, which will be described subsequently in greater detail, is to provide a new key ring opener assembly which has many of the advantages of the key rings and openers thereof mentioned heretofore and many novel features that result in a new key ring opener assembly which is not anticipated, rendered obvious, suggested, or even implied by any of the prior art key ring and openers thereof, either alone or in any combination thereof. The present invention includes a key ring having end portions overlapping ring segments thereof; and also includes a key ring opener being connectable to the key ring and being generally a thin rigid piece with flat first and second sides for spreading apart a selected end portion and a selected ring segment of the key ring to allow keys and other objects to be placed on the key ring; and further includes a connector for connecting the key ring opener to the key ring. None of the prior art describes the particular structure of the present invention.

There has thus been outlined, rather broadly, the more important features of the key ring opener assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new key ring opener assembly which has many of the advantages of the key rings and openers thereof mentioned heretofore and many novel features that result in a new key ring opener assembly which is not anticipated, rendered obvious, suggested, or even implied by any of the prior art key rings and openers thereof, either alone or in any combination thereof.

Still another object of the present invention is to provide a new key ring opener assembly for prying open the key ring so that keys and other objects can be placed upon the key ring.

Still yet another object of the present invention is to provide a new key ring opener assembly that is easy and convenient to use.

Even still another object of the present invention is to provide a new key ring opener assembly that allows the user to attach the key ring opener to the key ring and to spread apart ring segments to enable for the user to easily place keys and other objects on the key ring and also to remove keys and objects from the key ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
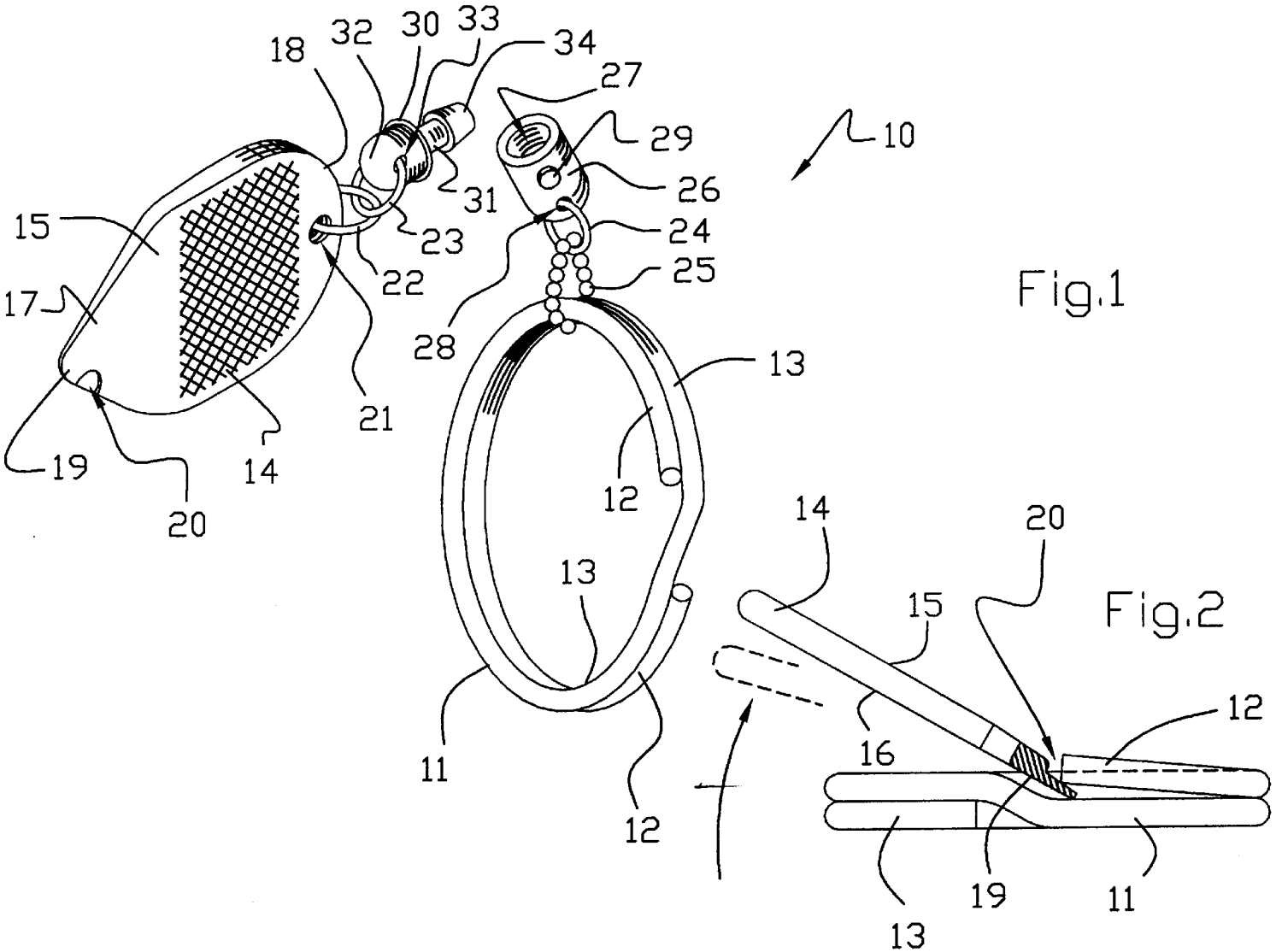
FIG. 1 is a perspective view of a new key ring opener assembly according to the present invention.
FIG. 2 is an edge elevational view of the present invention.
Figure 3:
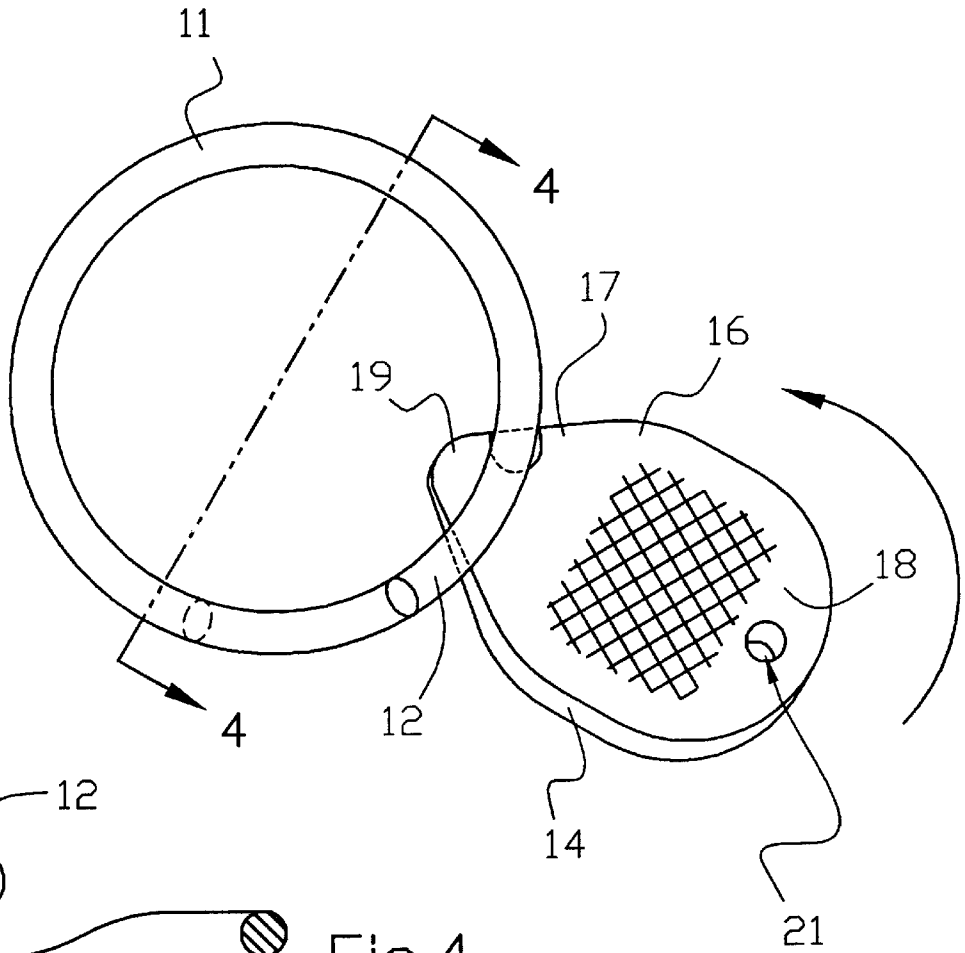
FIG. 3 is a side elevational view of the present invention.
Figure 4:
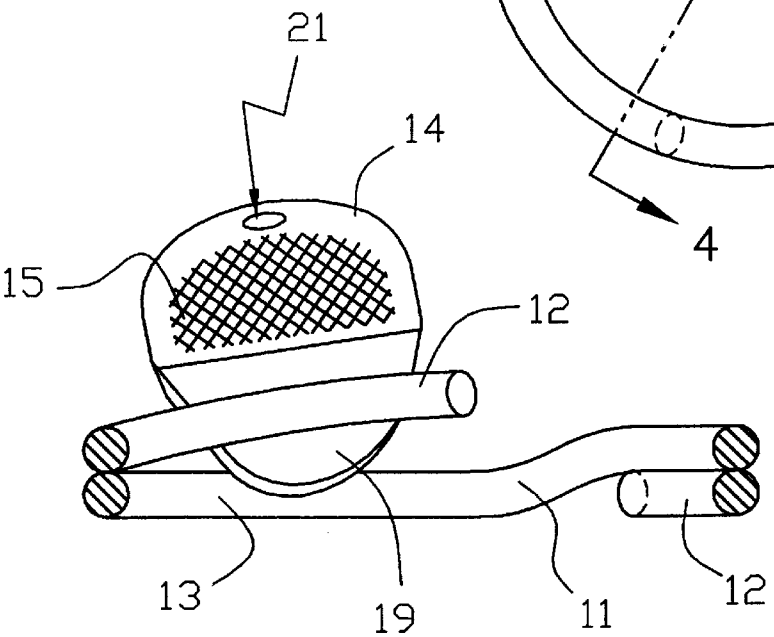
FIG. 4 is a cross-sectional view of the present invention.

With reference now to the drawings, and in particular to FIGS. 1 through 3 thereof, a new key ring opener assembly embodying the principles and concepts of the present invention and generally designated by the reference numeral 10 will be described.

As best illustrated in FIGS. 1 through 3, the key ring opener assembly 10 generally comprises a key ring 11 having end segments 12 overlapping intermediate segments 13 thereof. A key ring opener 14 is connectable to the key ring 11 and is generally a thin rigid piece with flat first and second sides 15,16 for spreading apart a selected end segment 12 and a selected intermediate segment 13 of the key ring 11 to allow keys and other objects to be placed on and off the key ring 11. The key ring opener 14 is wedge-shaped and also has a tongue-like portion 19 integrally protruding outwardly from a front end 17 thereof, and further has a notch 20 being disposed in the tongue-like portion 19 and in the flat first side 15 for spreading apart a selected end segment 12 and a selected intermediate segment 13 of the key ring 11. The notch 20 also is disposed through an edge of the flat first side 15 of the thin rigid piece. The thin rigid piece is tapered from a back end 18 to the front end 19 and has a hole 21 being disposed through the flat first and second sides 15,16 near the back end 18 thereof.

A connector assembly for connector the key ring opener 14 to the key ring 11 includes fastening rings 22–24 and an endless chain 25 with one of the fastening rings 22 being disposed through the hole 21 of the thin rigid piece and the endless chain 25 being conventionally connected to the key ring 11, and also includes a male connector 30 and a female connector 26 being detachably connected to one another and connected to the fastening rings 22–24. The female connector 26 is a cylindrical member having an open end 27, and also having a hole 28 being disposed through a wall and near a closed end thereof, and further having a button-like male-connector release member 29 being depressibly and conventionally disposed in the wall of the cylindrical member for releasing the male connector 30 from the female connector 26. The male connector 30 includes a stub shaft 31, and also includes a parabolic-shaped handle 32 being conventionally attached to a first end of the stub shaft 31 and having a hole 33 being disposed therethrough, and further includes a plug-like engagement member 34 being conventionally attached to a second end of the stub shaft 31 and having a diameter greater than that of the stub shaft 31 and being engagable in the female connector 26 to hold the key ring opener 14 to the key ring 11.

In use, the user places the front end 17 and tongue-like portion 19 of the key ring opener 14 at the end of one of the end segments 12 of the key ring 11 and wedges the tongue-like portion 19 between the end segment 12 and one of the intermediate segments 13 of the key ring with the very end of the end segment 12 being disposed in the notch 20 to spread the end segment 12 away from the intermediate segment 13 so that keys and other objects can be moved on and off the key ring 11. Once finished, the user simply removes the key ring opener from between the end segment 12 and the intermediate segment 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the key ring opener assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A key ring opener assembly comprising:

a key ring having end segments overlapping intermediate segments thereof;

a key ring opener being connectable to said key ring and being generally a thin rigid piece with flat first and second sides for spreading apart a selected said end segment and a selected said intermediate segment of said key ring to allow keys and other objects to be placed on and off said key ring, said key ring opener being wedge-shaped and also having a tongue-like portion integrally protruding outwardly from a front end thereof, and further having a notch being disposed in said tongue-like portion and in said flat first side for spreading apart a selected said end segment and a selected said intermediate segment of said key ring, said notch also being disposed through an edge of said flat first side of said thin rigid piece, said thin rigid piece being tapered from a back end to said front end and having a hole being disposed through said flat first and second sides near said back end thereof; and a connector for connecting said key ring opener to said key ring, said connector including fastening rings and an endless chain with one of said fastening rings being disposed through said hole of said thin rigid piece and another of said fastening rings being connected to said key ring, and also including a male connector and a female connector being detachably connected to one another and connected to said fastening rings.

2. A key ring opener assembly as described in claim 1, wherein said female connector is a cylindrical member having an open end, and also having a hole being disposed through a wall and near a closed end thereof, and further having a male-connector release member being depressibly disposed in said wall of said cylindrical member for releasing said male connector from said female connector.

3. A key ring opener assembly as described in claim 2, wherein said male connector includes a stub shaft, and also includes a parabolic-shaped handle being attached to a first end of said stub shaft and having a hole being disposed therethrough, and further includes plug-like engagement member being attached to a second end of said stub shaft and having a diameter greater than that of said stub shaft and being engageable in said female connector.

* * * * *